US007350596B1

(12) United States Patent
Attaya

(10) Patent No.: US 7,350,596 B1
(45) Date of Patent: Apr. 1, 2008

(54) METHODS AND APPARATUS FOR EXPANDING THE DIAMETER OF A BOREHOLE

(76) Inventor: James S. Attaya, 10638 Rector Rd., Sanger, TX (US) 76266-7415

( * ) Notice: Subject to any disclaimer, the term of this patent is extended or adjusted under 35 U.S.C. 154(b) by 0 days.

(21) Appl. No.: 11/502,280

(22) Filed: Aug. 10, 2006

(51) Int. Cl.
*E21B 7/28* (2006.01)
*E21B 10/32* (2006.01)

(52) U.S. Cl. ..... 175/57; 175/284; 175/285; 175/385; 166/212

(58) Field of Classification Search ..... 175/57, 175/284, 285, 289, 267, 406, 385; 166/212
See application file for complete search history.

(56) References Cited

U.S. PATENT DOCUMENTS

| | | | | |
|---|---|---|---|---|
| 1,402,503 | A * | 1/1922 | Krause | 175/284 |
| 2,334,788 | A * | 11/1943 | O'Leary | 175/267 |
| 2,654,575 | A * | 10/1953 | Kammerer | 175/266 |
| 3,115,935 | A * | 12/1963 | Hooton | 166/117.6 |
| 4,076,087 | A | 2/1978 | Chuply et al. | |
| 4,497,383 | A | 2/1985 | Ostertag | |
| 4,503,919 | A * | 3/1985 | Suied | 175/269 |
| 5,368,114 | A | 11/1994 | Tandberg et al. | |
| 5,662,182 | A | 9/1997 | McLeod et al. | |
| RE36,817 | E | 8/2000 | Pastusek et al. | |
| 6,116,356 | A | 9/2000 | Doster et al. | |
| 6,213,226 | B1 | 4/2001 | Eppink et al. | |
| 6,378,632 | B1 | 4/2002 | Dewey et al. | |
| 6,615,933 | B1 | 9/2003 | Eddison | |
| 6,708,785 | B1 | 3/2004 | Russell et al. | |
| 6,851,491 | B2 * | 2/2005 | Marshall | 175/267 |
| 6,902,014 | B1 | 6/2005 | Estes | |
| 6,913,098 | B2 | 7/2005 | Fielder et al. | |
| 6,920,944 | B2 | 7/2005 | Eppink et al. | |
| 6,953,096 | B2 | 10/2005 | Gledhill et al. | |
| 6,973,978 | B2 * | 12/2005 | Cravatte | 175/57 |
| 2004/0195006 | A1 * | 10/2004 | Groves et al. | 175/57 |
| 2005/0092498 | A1 * | 5/2005 | Pia | 166/370 |
| 2006/0131076 | A1 * | 6/2006 | Zupanick | 175/57 |

* cited by examiner

*Primary Examiner*—Jennifer H. Gay
*Assistant Examiner*—Shane Bomar
(74) *Attorney, Agent, or Firm*—Cesari and McKenna, LLP

(57) ABSTRACT

A borehole reamer which may be deployed to a desired depth in an existing uncased borehole or below existing casing and used to substantially expand the diameter of the borehole. The diameter may be expanded by an amount that ranges from a fraction to a multiple of the original diameter of the borehole. In this fashion, geological formations containing oil, gas or groundwater which were previously uneconomical to produce may be worked into a condition of economical production. In a preferred embodiment, the borehole reamer is formed as an elongated assembly having an outside diameter which is sized to fit within a diameter of a conventional borehole. The assembly is preferably attached to drill pipe and lowered into a borehole to an appropriate depth corresponding to a pay zone of interest. A lower portion of the assembly, which is located at the deeper depth in the borehole, is constructed in the form of a bellows which functions as a pilot/anchor for the assembly. A group of deployable cutting elements are disposed above the bellows and below a sliding power transfer unit which forms the upper portion of the assembly and attaches to a drill stem.

20 Claims, 10 Drawing Sheets

METHODS AND APPARATUS FOR EXPANDING THE DIAMETER OF A BOREHOLE

BACKGROUND OF THE INVENTION

1. Field of the Invention

The present invention relates generally to field of drilling or boring and, more specifically, to an apparatus which may be used to ream, underream or backream a borehole such that the borehole diameter is increased by a desired amount up to several multiples of the original diameter.

2. Background Information

Conventional drilling for oil, gas or groundwater is typically done by boring a hole having a diameter on the order of 6 to 10 inches. The borehole is extended to a sufficient depth to reach one or more geological structures of interest (i.e., pay zones) which are known or believed to exist.

It is well known that large quantities of oil, gas and groundwater are reachable but have remained largely undeveloped because the geological formations which contain these resources exhibit little or no permeability and very low porosities. An example of such a formation is found in southern Mississippi and adjacent areas of Louisiana. The formation consists essentially of oil saturated shale with dissolved natural gas, at approximate depths of 10,000 to 14,000 feet, and having net thickness on the order of 25 to 250 feet. A borehole of conventional size, drilled vertically into the shale and completed using conventional methods, may only produce on the order of 1 to 5 barrels of oil per day. In terms of historical market prices for crude oil, such low volume renders production uneconomical in view of the costs of drilling, completion and extraction.

One conventional approach to this problem involves injection of various liquids, laden with solid particles of appropriate size and concentration, under high pressure to create fractures and channels which enable the resource to exit the formation and enter the borehole. However, high-pressure fracturing in a pay zone will largely fail if the zone is not underlain and overlain by dense, impermeable strata. Otherwise, the fracturing elements, including the high pressure, are dissipated and ineffective.

In other geological settings, very thin strata of very fine granular sediments are sandwiched between substantially thicker strata of impermeable rock. These very thin pays zones are extremely difficult to target by perforations through casing in conventional vertical boreholes. Further, such thin pay zones are not always susceptible to improvement of deliverability by induced high-pressure fracturing or extended reach or horizontal boreholes.

SUMMARY OF THE INVENTION

In brief summary, the present invention provides a borehole reamer which may be deployed to a desired depth in an existing uncased borehole or below existing casing and used to substantially expand the diameter of the borehole. The diameter may be expanded by an amount that ranges from a fraction to a multiple of the original diameter of the borehole. In this fashion, geological formations containing oil, gas or groundwater which was previously uneconomical to produce may be worked into a condition of economical production.

In a preferred embodiment, the present invention is formed as an elongated assembly having an outside diameter which is sized to fit within a diameter of a conventional borehole. The assembly is preferably attached to drill pipe and lowered into a borehole to an appropriate depth corresponding to a pay zone of interest. A lower portion of the assembly, which is located at the deeper depth in the borehole, is constructed in the form of a bellows which functions as a pilot/anchor for the assembly. A group of deployable cutting elements are disposed above the bellows and below a sliding power transfer unit which forms the upper portion of the assembly and attaches to a drill stem.

In operation, the borehole reamer is lowered into a borehole to an appropriate depth. Drilling fluid is introduced into the bellows which expands laterally into the borehole wall, thereby effectively anchoring the lower end of the assembly. Next, the power transfer unit is forced bottomward by either drilling fluid pressure or by the weight of the drill string bearing on the anchored bellows. Thus, the cutting elements flex outwardly into the borehole wall while rotating with the drill stem. The cutting elements are of sufficient size that, when fully deployed, they may cut away sufficient material to expand the diameter of the borehole on the order of several feet.

Once the borehole diameter is expanded by the desired amount, including back-reaming, if needed, drill string rotation is reversed, momentarily, to unlock the power transfer unit, thereby releasing the cutting elements to return to their original positions. At this point, the reamer may be withdrawn from the hole and conventional drilling or other operations resumed. Alternatively, the borehole reamer may be repositioned at a different depth of interest and the process repeated.

One of the major advantages of the present invention is the ability to accurately target borehole diameter expansion to depths of interest. Thus, the present invention represents a significant advance over prior approaches in which the borehole diameter is increased down the full depth of the hole at substantial cost. Another major advantage of the present invention is the ability to substantially expand the borehole diameter on the order of feet or teens of feet, thereby dramatically increasing the exposed surface area of the resource-bearing formation and, in turn, increasing the volume of resource which exits the formation into the borehole.

Another major advantage of the present invention is the ability to substantially prevent "drifting" or deviation. This is achieved through a combination of the anchor bellows and power transfer unit remaining in constant contact with the borehole wall. Directional stability is enhanced by the geometric balance or symmetry of the borehole reamer and the common longitudinal axis of the original borehole and assembly of rotating elements from surface to bottom of borehole.

Other advantages of the present invention include simplicity of construction, assembly, downhole insertion, operational expansion and contraction, and uphole retrieval, when appropriately dimensioned, for tasks commonly performed by conventional borehole reamers.

The present invention may also be advantageously used in applications not related to the production of resources. In construction projects which require footings to support heavy structures, the present invention may be used to ream or backream suitable spaces into which concrete may be poured or pumped under pressure.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
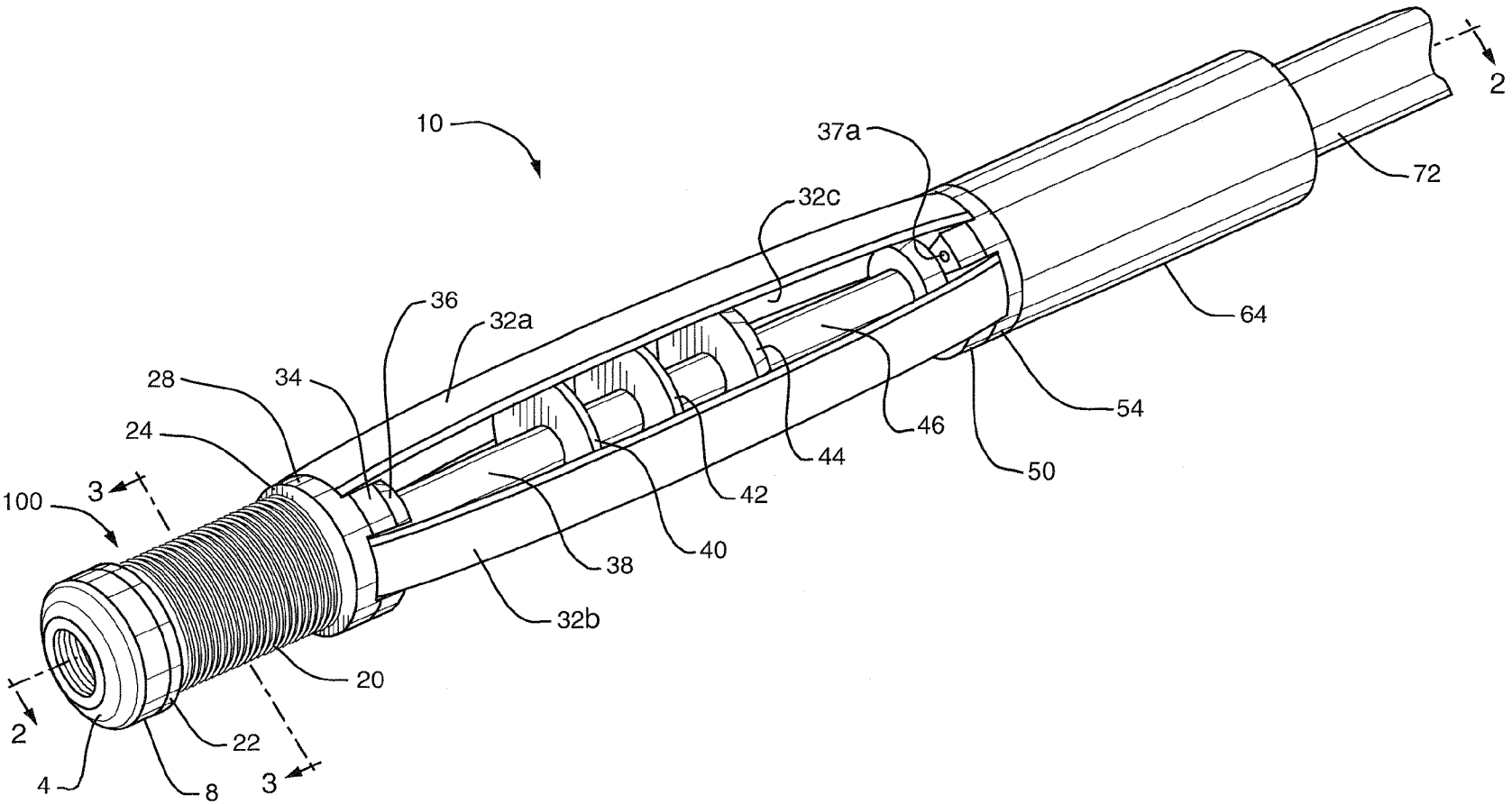
FIG. 1 is an isometric view of a borehole reamer, constructed in accordance with a preferred embodiment of the present invention, in a resting or fully retracted position.

FIG. 1 shows a borehole reamer 10 in a fully retracted or resting position. One end of reamer 10 is an expandable pilot/anchor assembly 100 which, under normal operation, would be inserted first into a borehole. Expandable pilot/anchor assembly 100 includes a tooljoint 4 to which a joint of pipe (not shown) or other structure may be attached. A baseplate 8 is disposed between tooljoint 4 and a lower ring clamp 22. An anchor bellows 20 is disposed between an upper ring clamp 24 and lower ring clamp 22. A structure denoted by reference number 28 serves as a both a headplate for pilot/anchor assembly 100 and a lower footplate for the middle portion of reamer 10. For conciseness, the structure denoted by reference number 28 will hereafter be referred to as lower footplate 28.

The middle portion of reamer 10 includes three flexible cutting elements 32*a*, 32*b* and 32*c*, respectively. For conciseness, the cutting elements may be referred to collectively by reference number 32. In a preferred embodiment, cutting elements 32*a*, 32*b* and 32*c* are substantially identical in structure and function. The number, arrangement and shapes of cutting elements 32 may be varied to suit the requirements of a particular application. The edges or surfaces of cutting elements 32 may be sharpened, serrated or otherwise embellished with geometrical features to enhance the ability of the cutting elements 32 to remove material within a borehole. Cutting elements 32 may be constructed from a variety of materials of appropriate toughness, strength and resiliency including spring-quality metal, alloys or chemically compounded materials which possess the appropriate qualities. Thus, further description set forth below with respect to any one of the cutting elements should be understood to be representative of all of the cutting elements.

One end of each cutting element 32 is positioned in accommodating slots or recesses formed in lower footplate 28 and, when in a resting position as shown, lies within a corresponding accommodating slot or recess provided in an upper footplate 34. The other end of each cutting element 32 is similarly accommodated in slots or recesses formed in a lower headplate 50 and an upper headplate 54.

An axial conduit 38 extends along the length of the middle portion of reamer 10. Axial conduit may be constructed in a number of ways including either as a single piece or as a series of segments which are joined together by tooljoints or other suitable arrangements. An upper portion 46 of axial conduit 38 is preferably made with a hard, polished outer surface which enables a smooth operating action as described below.

In a preferred embodiment, lower footplate 28 is firmly attached to the outside of axial conduit 38 by way of a threaded connection or other suitable structure. Upper footplate 34 is not firmly attached to axial conduit 38, but instead is free to slide with respect to the conduit 38. Similarly, upper and lower headplates 54 and 50 are free to slide with respect to axial conduit 38. Firmly attached to the outside of axial conduit 38 are two spacer/stabilizer plates 40 and 42, respectively. Also firmly attached to the outside of conduit 38 is spacer/stabilizer plate 44 which also functions as a stop, as described below. A support collar 36 is also attached to the outside of conduit 38 adjacent to upper footplate 34. An upper headplate 54 is disposed proximate to lower headplate 50. A threaded aperture 37*a* indicates the position of one of three fasteners which secure lower headplate 50 with upper headplate 54.

The upper portion of reamer 10 includes a sliding power transfer unit 64 which is attached at one end to upper headplate 54 and at the other end to a drill string 72. Power transfer unit is capable of moving along the upper portion 46 of axial conduit 38 as described below.

Figure 1A:
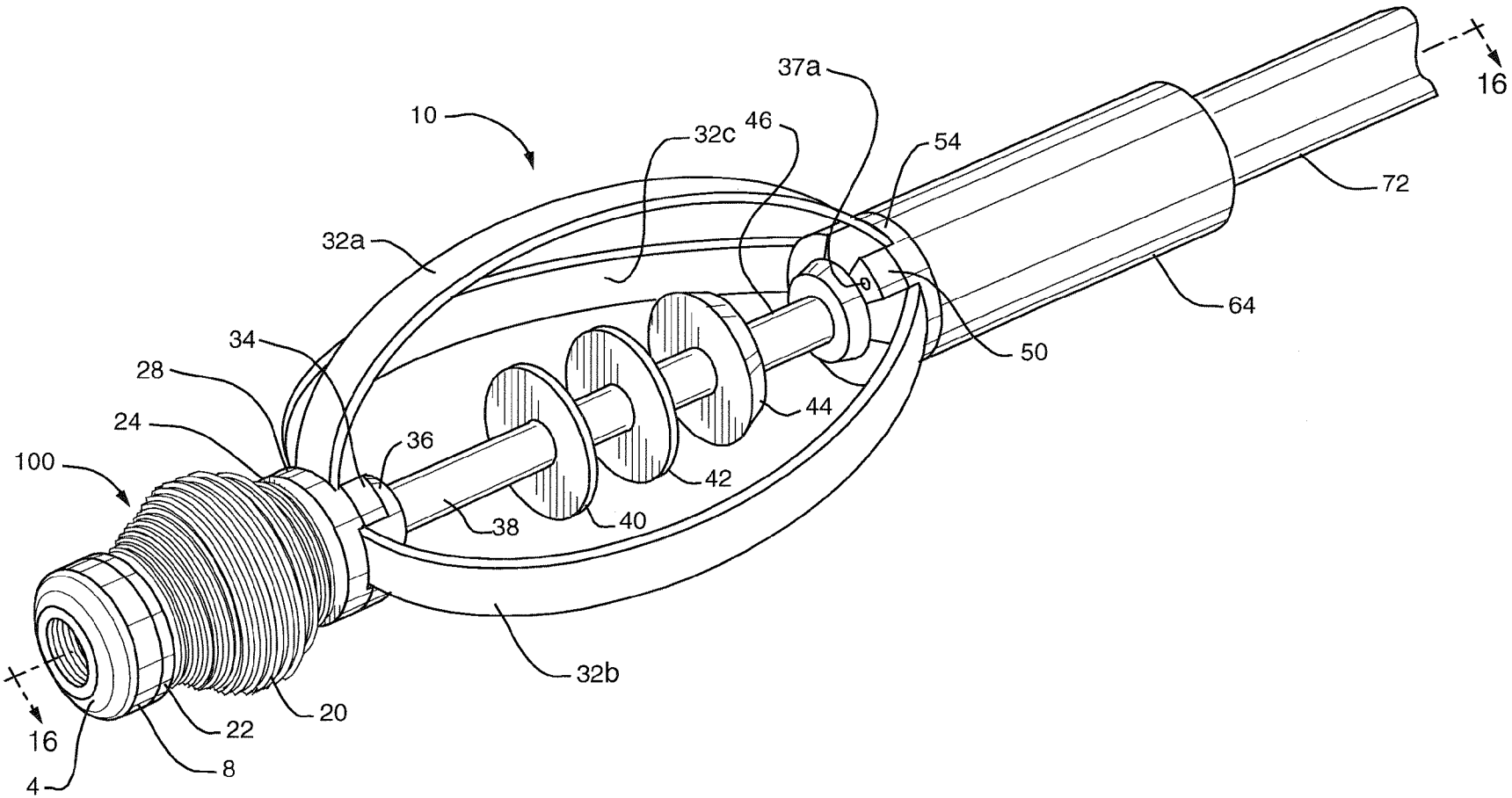
FIG. 1A is an isometric view of the borehole reamer of FIG. 1 in a partially deployed position.
Figure 1B:
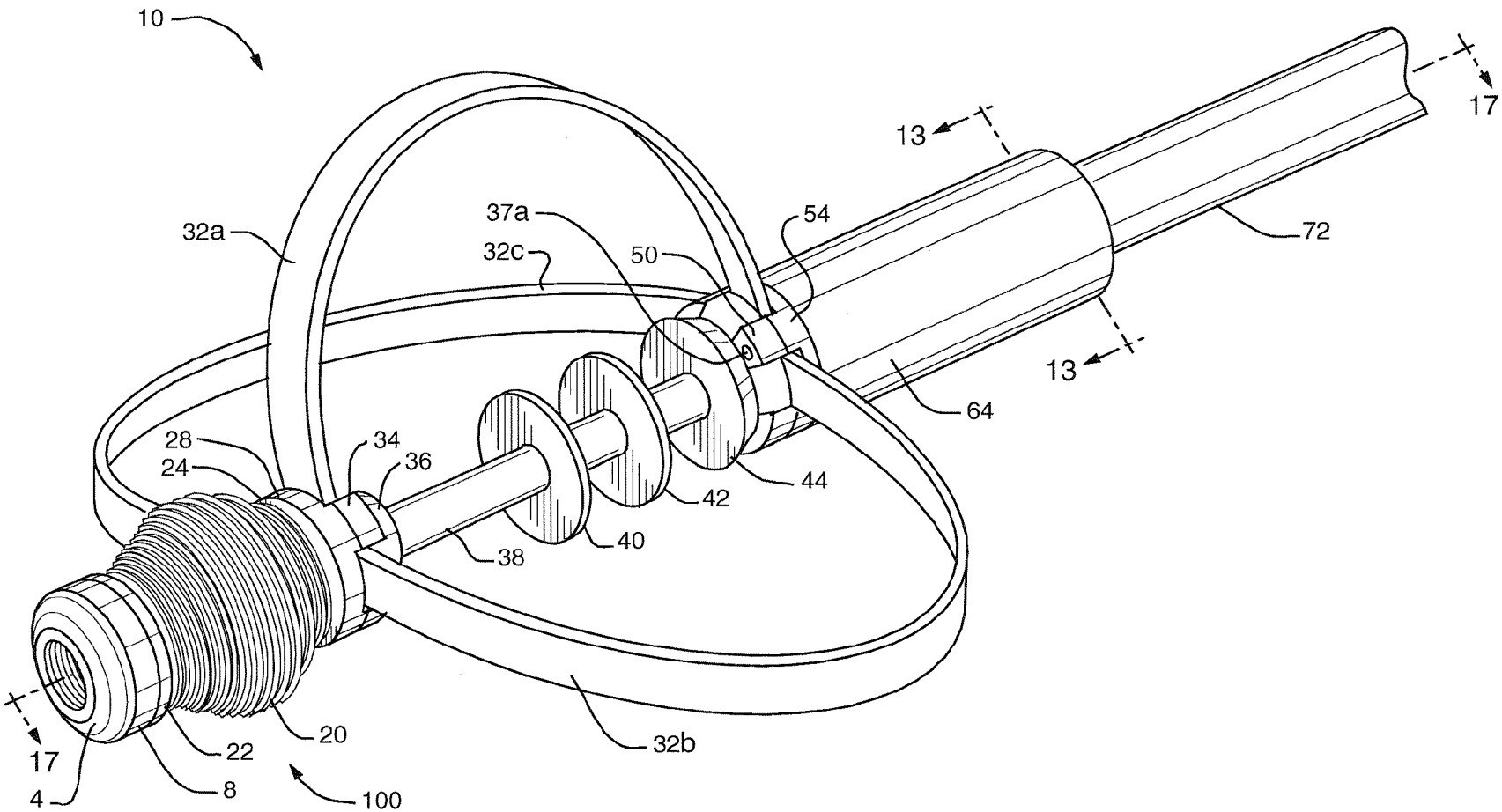
FIG. 1B is an isometric view of the borehole reamer of FIG. 1 in a fully deployed position.

FIG. 1A shows reamer 10 in a partially deployed position in which pilot/anchor assembly 100 is fully expanded and cutting elements 32 are partially deployed. Cutting elements 32 are bowed outward as they are compressed by the motion of power transfer unit 64 sliding longitudinally downward along the upper portion 46 of axial conduit 38. As shown in FIG. 1B, once lower headplate 50 contacts spacer/stabilizer plate 44 and is stopped, reamer 10 has reached a fully deployed position.

Figure 2:
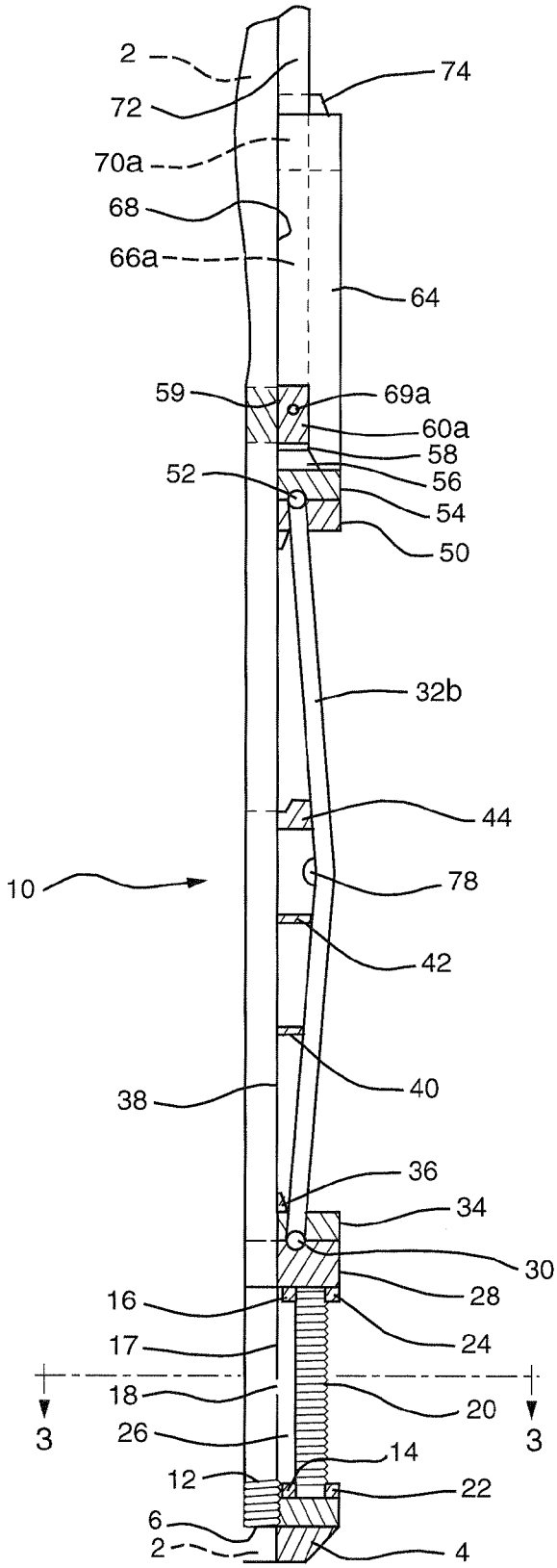
FIG. 2 is a partial vertical section taken along line 2-2 of FIG. 1.

FIG. 2 is a partial vertical section taken along line 2-2 of FIG. 1. For purposes of enhanced clarity, FIG. 2 and other sectional views herein are schematic to the extent that they show certain elements that would actually be hidden in a true sectional view. A pressure valve 6 and a coil spring 12 are disposed within axial conduit 38. A lower friction ring 14 works in conjunction with ring clamp 22 to secure the lower end of anchor bellows 20. Similarly, an upper friction ring 16 works with ring clamp 24 to secure the upper end of anchor bellows 20. A lower extension 17 of axial conduit 38 extends longitudinally through bellows 20. An aperture 18 in the sidewall of axial conduit 38 permits drill mud, denoted by reference number 2, to fill an annular chamber 26 defined between anchor bellows 20 and axial conduit 38.

Ends 30 and 52 of cutting element 32*b* are preferably formed as a generally cylindrical, integral portion of the cutting element. End 30 is clasped between footplates 28 and 34 such that end 30 may rotate on the order of 90 degrees during normal operation of reamer 10. End 52 is similarly clasped between headplates 50 and 54. An eyelet 78, disposed on the inside surface of cutting element 32*b*, serves as an attachment point for a stabilizer cord (not shown). A tooljoint 56 connects upper headplate 54 with power transfer unit 64. An axial conduit sub 59 and an appended power transfer key 60*a* are disposed within a center bore 68 and keyway 66*a*, respectively, of power transfer unit 64. Power transfer unit 64 slides over and along axial conduit 59 and appended key 60*a*. A locking chamber 70*a* within the upper end of power transfer unit 64 will accommodate sub 59 and key 60*a* and provides longitudinal stops for power transfer unit 64 Circumferential stops, not shown in FIG. 2, in locking chamber 70*a* are shown and described below, particularly in connection with FIG. 13. A keyway 66*a* and center bore 68 provide passage through which power transfer key 60*a* and sub 59 travel. A tooljoint 74 connects reamer 10 with drill string 72.

Figure 3:
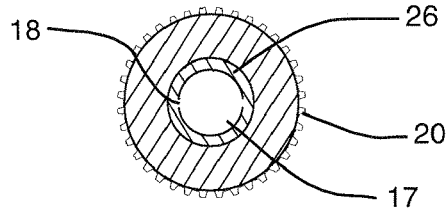
FIG. 3 is a horizontal cross-section taken along line 3-3 of FIG. 1.

FIG. 3 is a cross section in plane 3-3 (FIG. 1) of expandable pilot/anchor assembly 100. Annular chamber 26 is defined by the inner wall of bellows 20 and extension 17 of axial conduit 38. Aperture 18 provides a fluid passage between the interior of axial conduit 38 and annular chamber 26.

Bellows 20 may be constructed from a variety of appropriately tough, strong, resilient material including plastic and rubber. The exterior surface of bellows 20 is preferably shaped to permit drilling mud or other fluid to pass around bellows 20 in its return to the surface. Such fluid passage is enabled by the ribbed or corrugated exterior surface shown. The exterior surface may be embellished with other geometric features including studs or bosses, abrasive particles or fragments, arranged either randomly or in a predetermined pattern, which enhance the ability of bellows 20 to engage a borehole wall as described below.

Figure 4:
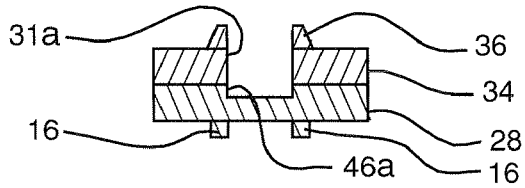
FIG. 4 is a front elevation view of the unloaded lower and upper footplates of the borehole reamer of FIG. 1.

FIG. 4 is a cross section/front elevation view of lower footplate 28, upper footplate 34 and support collar 36 in isolation from other structures. A slot or recess 31*a*, one of three such slots or recesses provided in upper footplate 34, is shaped and dimensioned to accommodate one cutting element 32 (not shown in this figure). A slot or recess 46*a*, one of three such slots or recesses provided in lower footplate 28, is substantially aligned with slot 31*a* to similarly accommodate one cutting element 32.

Figure 5:
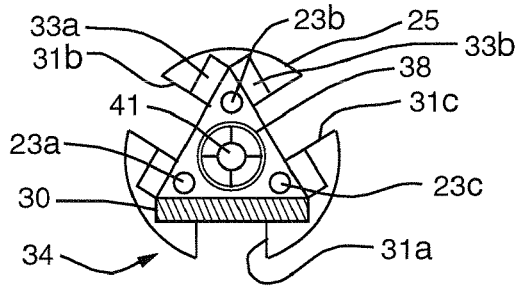
FIG. 5 is a bottom plan view of the mate-face of the upper footplate of FIG. 4 with one cutting element loaded therein.

FIG. 5 is a bottom plan view of a mate-face 25 of upper footplate 34. Three slots 31*a*, 31*b* and 31*c* are provided to accommodate cutting elements 32. Semicylindrical recesses 33*a* and 33*b*, which represent two of three such recesses, are provided to accommodate three cutting element ends 30, one of which is shown. Recesses 33 work, in conjunction with recesses 27 in lower footplate 28, to effectively enclose cutting element ends 30 while permitting such ends to freely rotate during the outward bowing and retracting action of cutting elements 32. Threaded apertures 23*a*, 23*b* and 23*c* correspond, respectively, with apertures 35*a*, 35*b* and 35*c* and provide accommodation for screwpins (not shown) or other fasteners that couple lower footplate 28 with upper footplate 34. Disposed within axial conduit 38 is a spinal rod 41.

Figure 6:
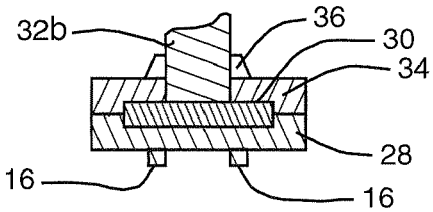
FIG. 6 is a partial vertical section of the lower and upper footplates of FIG. 4 with a cutting element loaded therein.

FIG. 6 is a modified vertical section showing the assembled upper and lower footplates 34 and 28 clasped around end 30 of cutting element 32*b*.

Figure 7:
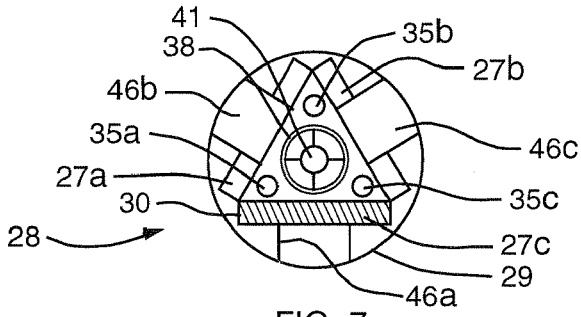
FIG. 7 is a top plan view of the mate-face of the lower footplate of FIG. 4 with one cutting element loaded therein.

FIG. 7 shows a top plan view of a mate-face 29 of lower footplate 28. Three slots 46*a*, 46*b* and 46*c*, each for accommodating one end of a cutting element, are provided. Three semicylindrical recesses 27*a*, 27*b* and 27*c* are provided to accommodate ends 30 of cutting elements 32. Threaded apertures 35*a*, 35*b* and 35*c* receive screwpins (not shown) or other fasteners that couple lower footplate 28 with upper footplate 34.

Figure 8:
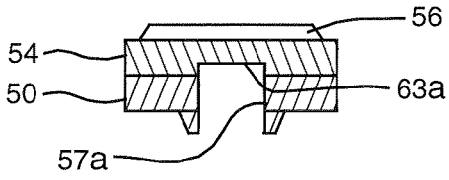
FIG. 8 is a front elevation view of the unloaded lower and upper headplates of the borehole reamer of FIG. 1.

FIG. 8 is a cross section/front elevation view of lower headplate 50, upper headplate 54 and tooljoint connection 56 in isolation from other structures. A slot or recess 63*a*, one of three such slots or recesses provided in upper headplate 54, is shaped and dimensioned to accommodate an end of one cutting element 32 (not shown in this figure). A slot or recess 57*a*, one of three such slots or recesses provided in lower headplate 50, is substantially aligned with slot 63*a* to similarly accommodate an end of one cutting element 32.

Figure 9:
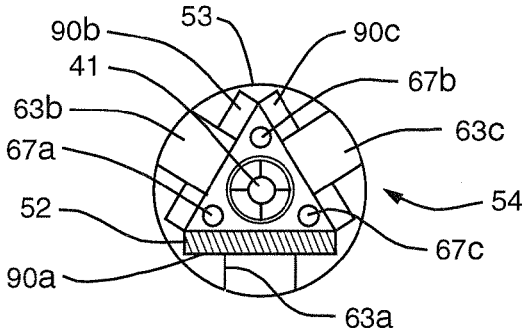
FIG. 9 is a bottom plan view of the mate-face of the upper headplate of FIG. 8 with one cutting element loaded therein.

FIG. 9 shows a bottom plan view of a mate-face 53 of upper headplate 54. Three slots 63*a*, 63*b* and 63*c*, each for accommodating one end of a cutting element, are provided. Three semicylindrical recesses 90*a*, 90*b* and 90*c* are provided to accommodate ends 52 of cutting elements 32. Threaded apertures 67*a*, 67*b* and 67*c* receive screwpins (not shown) or other fasteners that couple upper headplate 54 with lower headplate 50. Recesses 63 work, in conjunction with recesses 57 in lower headplate 50, to effectively enclose cutting element ends 52 while permitting such ends to freely rotate during the outward bowing and retracting action of cutting elements 32.

Figure 10:
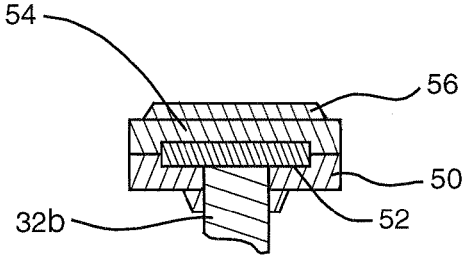
FIG. 10 is a partial vertical section of the lower and upper headplates of FIG. 8 with a cutting element loaded therein.

FIG. 10 is a modified vertical section showing the assembled lower and upper headplates 50 and 54 clasped around end 52 of cutting element 32*b*.

Figure 11:
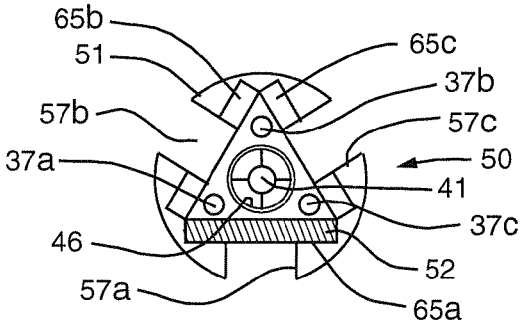
FIG. 11 is a top plan view of the mate-face of the lower headplate of FIG. 8 with one cutting element loaded therein.

FIG. 11 is a top plan view of a mate-face 51 of lower headplate 50. Semicylindrical recesses 65*a* and 65*b*, which represent two of three such recesses, are provided to accommodate three cutting element ends 52, one of which is shown. Threaded apertures 37*a*, 37*b* and 37*c* provide accommodation for screwpins (not shown) or other fasteners that couple lower headplate 50 with upper headplate 54.

Figure 12:
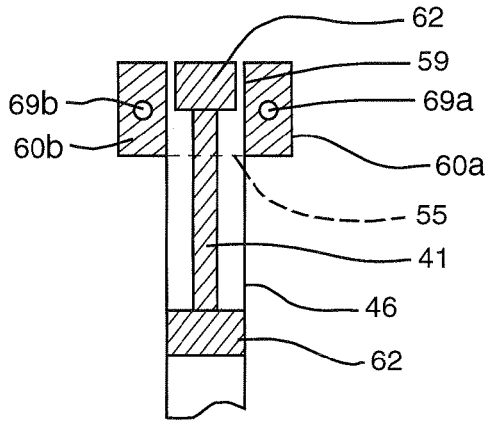
FIG. 12 is a vertical section of the upper portion of the axial conduit of the borehole reamer shown in FIG. 1.

FIG. 12 is a vertical section showing axial conduit sub 59 and the upper portion 46 of axial conduit 38 as they would be disposed in a lower portion of power transfer unit 64 shown in FIG. 1. Spinal rod 41 with appendages 62 appropriately placed, longitudinally and circumferentially, is disposed within axial conduit 38 and extends to lower footplate 28. Spinal rod 41 serves to maintain axial stability and rigidity of the reamer 10 during operation. Power transfer keys 60*a* and 60*b*, each of which has a through hole 69*a* and 69*b*, respectively, are appended to axial conduit sub 59. Holes 69*a* and 69*b* augment passage of drilling fluid when power transfer keys 60*a* and 60*b* rotate in locking chambers 70*a* and 70*b*. Reference number 55 denotes a threaded connection between upper portion 46 of axial conduit 38 and axial conduit sub 59.

Figure 13:
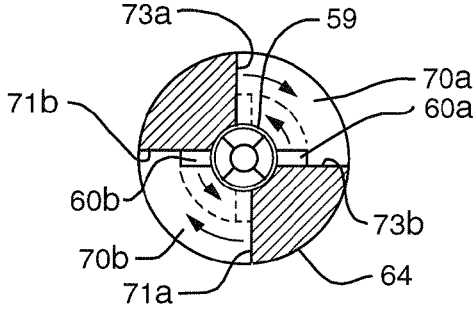
FIG. 13 is a cross-section taken along line 13-13 of FIG. 1B showing a locking chamber portion of a sliding power transfer unit.

FIG. 13 is a cross-section, taken from FIG. 1B, showing two locking chambers 70*a* and 70*b* located in the upper portion of power transfer unit 64. Power transfer keys 60*a* and 60*b* are shown entering locking chambers. At the instant the keys completely exit their respective keyways (e.g., keyway 66*a* of FIG. 2), counter-rotation torque on fully deployed cutting elements 32 together with continued rotation of power transfer unit 64 causes power transfer keys 60*a* and 60*b* to fly against locking chamber walls 71*a* and 73*a*. Cutting elements are thus locked in the fully deployed position. Brief cessation of mud pump pressure will cause collapse of bellows 20. Lifting of drill string 72 allows backreaming to proceed or, alternatively, counter-rotation of drill string 72 and power transfer unit 64 will send the keys 60*a* and 60*b* to bear against locking chamber walls 71*b* and 73*b*. Reflex or recoil action of cutting elements 32 pulls power transfer keys bottomward through the keyways. Cutting elements 32 return to a retracted position. Reamer 10 may now be repositioned to a different depth of interest or retrieved to the surface.

Figure 14:
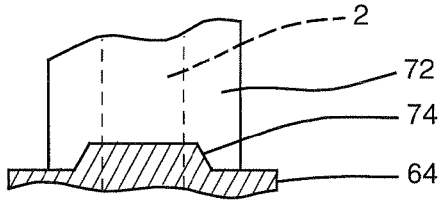
FIG. 14 is a partial cross-section showing a tooljoint connection between the borehole reamer of FIG. 1 and an uphole drill string to which the reamer may be attached.

FIG. 14 shows the upper end of power transfer unit 64 coupled to drill string 72 by way of tooljoint 74. As before, reference number 2 denotes the general flow path of drill mud within drill string 72.

Figure 15:
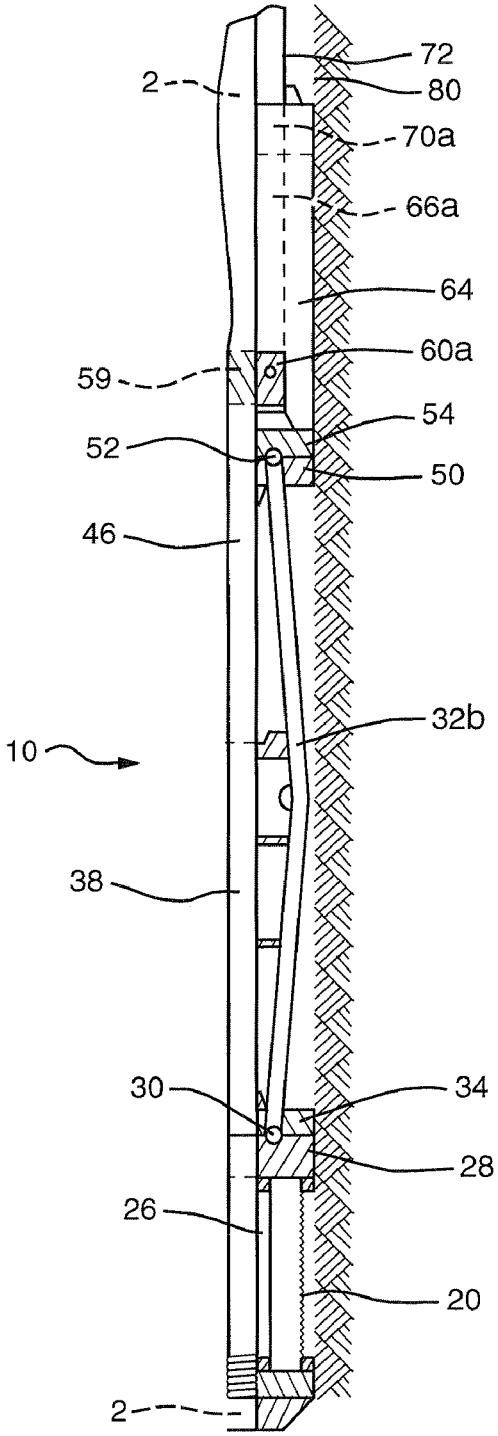
FIG. 15 is a partial vertical section of the borehole reamer within a borehole in a resting or fully retracted position.
Figure 15A:
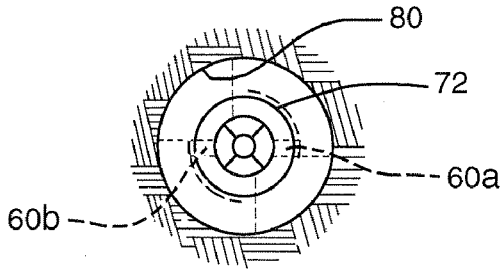
FIG. 15A is a modified top view which corresponds with FIG. 15.

The detailed operation of reamer 10 will now be described with reference to FIGS. 15, 15A and subsequent figures. In FIG. 15, reamer 10 is shown, in partial vertical cross section, in a fully resting or retracted position after being lowered into a borehole (cased or uncased). Footplates 28 and 34, headplates 50 and 52 and power transfer unit 64 are all in contact or nearly in contact with borehole wall 80.

Once reamer 10 is positioned at the appropriate depth, the drill string 72 may be slowly rotated and drill mud 2 is pumped through the length of drill string 72 and axial conduit 38 and into the open borehole below reamer 10. Drill mud 2 returns to the surface via the annulus created between the drill string 72 and borehole wall 80. The fluid pressure inside axial conduit 38 is greater than the pressure in the borehole annulus outside of the conduit. Consequently, drill mud 2 will enter anchor bellows 20 through orifices 18 (FIGS. 2 and 3), causing bellows 20 to expand and engage borehole wall 80. Once fully expanded, anchor bellows 20 should provide sufficient frictional force to pre-vent longitudinal movement of the lower portion of reamer 10 (i.e., the portion below upper footplate 34) during the following actions.

After an appropriate interval of time, drill string 72 is allowed to slowly bear downward causing pressure to be exerted upon headplates 50 and 54. Footplates 28 and 34 remain essentially stationary. By precisely measuring the downward movement of drill string 72 and a corresponding reduction in the weight carried by the rig at the surface, it may be ascertained whether anchor bellows 20 is holding fast and whether cutting elements 32 have flexed sufficiently to engage borehole wall 80. If so, rotation of drill string 72 may resume at an appropriate rate. Anchor bellows 20 may rotate with drill string 72 or not depending upon how friction rings 22 and 24 are set.

Figure 16:
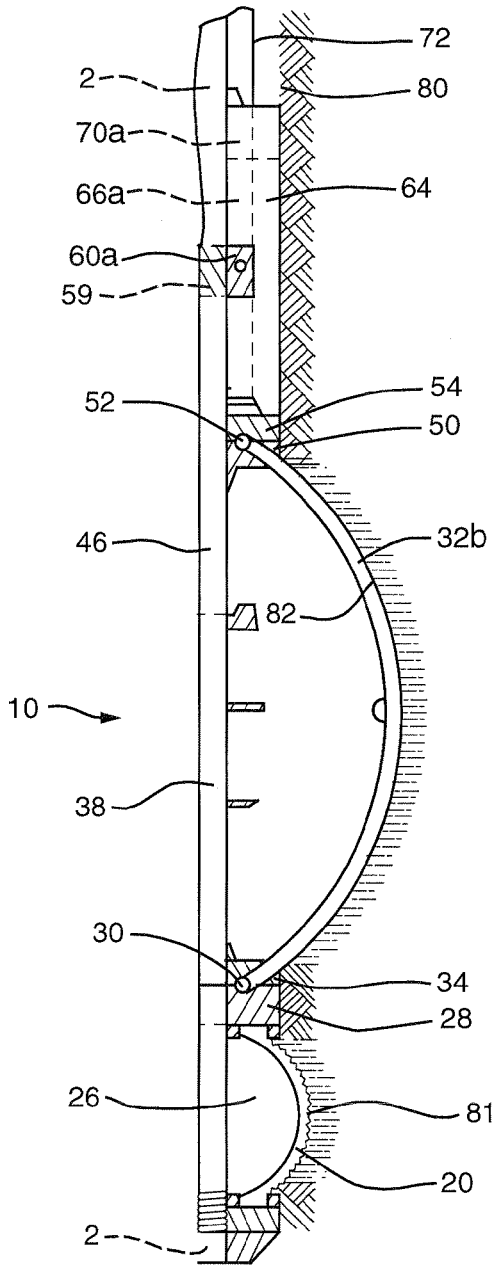
FIG. 16 is a partial vertical section of the borehole reamer within a borehole in a partially deployed position.
Figure 16A:
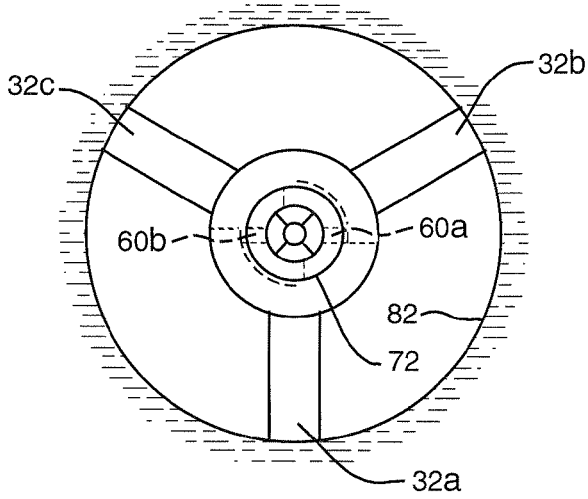
FIG. 16A is a modified top view which corresponds with FIG. 16.

As may be seen best in FIGS. 16 and 16A, with drill string 72 rotating, power transfer unit 64, along with headplates 50 and 54, moves downwardly and telescopically over the upper portion 46 of axial conduit 38. This downward action, in turn, causes cutting elements 32 to bow or flex outward, thereby chipping, scouring, scraping, carving, grinding, rasping and gouging away material from borehole wall 80. Anchor bellows 20 has, as result of its expansion, increased the diameter of the borehole a certain amount in region 81.

Figure 17:
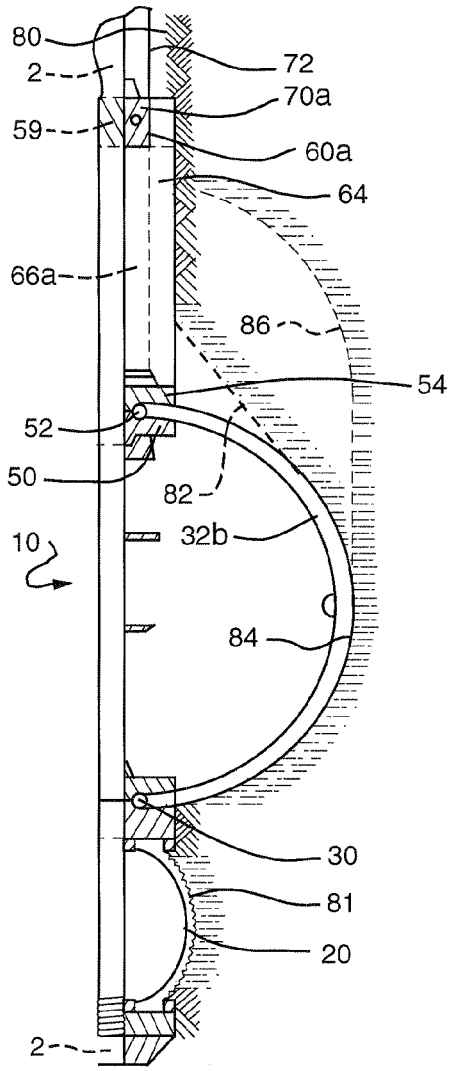
FIG. 17 is a partial vertical section of the borehole reamer within a borehole in a fully deployed position.
Figure 17A:
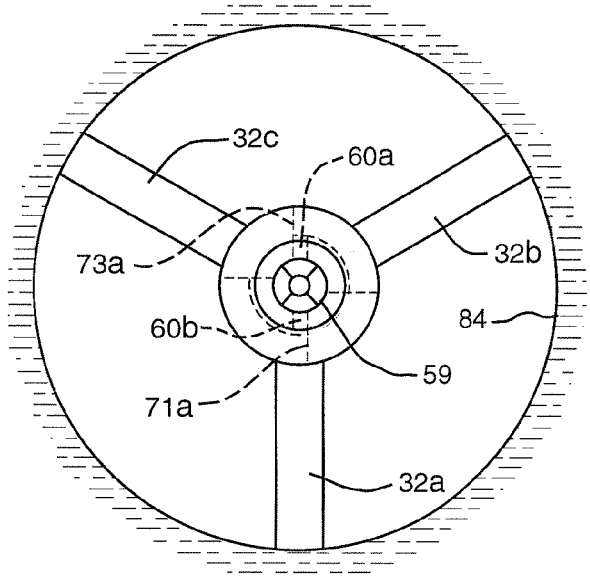
FIG. 17A is a modified top view which corresponds with FIG. 17.

As the full range of downward motion is achieved by power transfer cylinder 64 and cutting elements 32 are flexed to a maximum, the borehole diameter has substantially increased as shown in FIGS. 17 and 17A.

Figure 18:
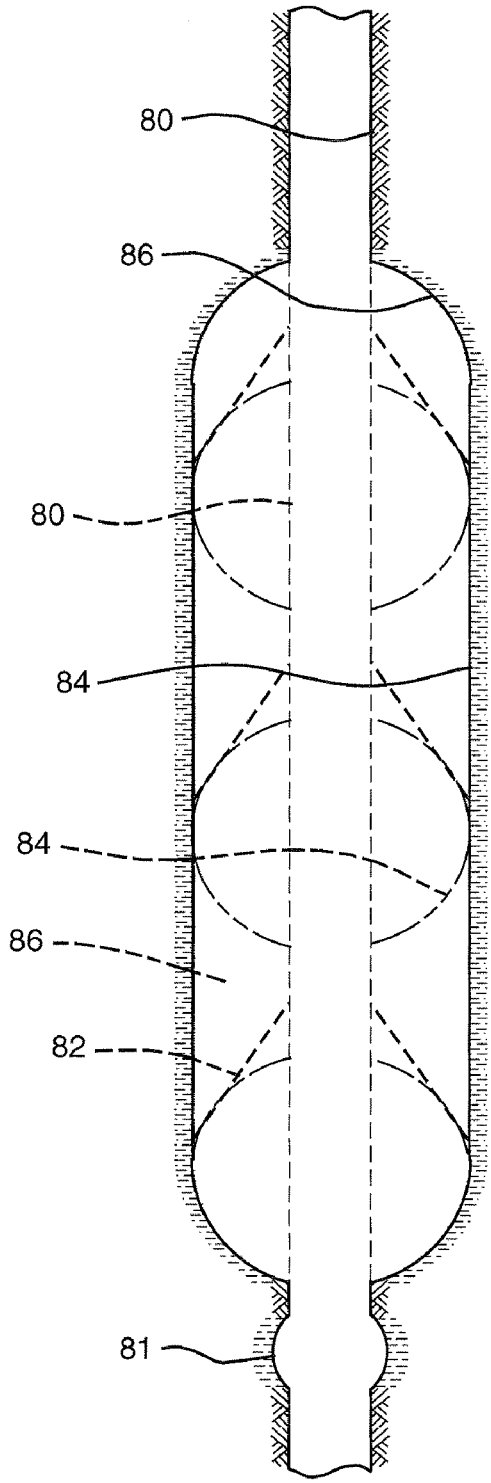
FIG. 18 is a vertical cross-section showing a backreamed borehole resulting from the operation of the present invention.

FIG. 18 schematically shows the aggregate expansion of borehole diameter produced by using reamer 10 as described above. Reference number 81 approximately indicates the expansion created by anchor bellows 20 when rotated. Reference number 82 indicates the approximate expansion created when cutting elements 32 transition from a resting position (FIG. 15) to a fully deployed position (FIG. 17). Reference number 84 indicates the approximate expansion created when cutting elements 32 are fully deployed and locked. Reference number 86 indicates the approximate expansion created when reamer 10 is used to backream with cutting elements 32 fully deployed and locked, as more fully described above in connection with FIG. 13.

In accordance with another aspect of the present invention, expandable pilot/anchor assembly 100 may be used by itself to expand a borehole diameter. As may be seen best in FIGS. 16, 17 and 18, by inserting expandable pilot/anchor assembly 100 into a borehole, lowering it to a desired depth, and expanding bellows 20 as described above, the borehole diameter may be expanded. Further, by raising or lowering assembly 100 and repeating this process, a borehole diameter may be expanded within a vertical range of interest.

While the presently preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. An apparatus for expanding a diameter of a borehole at a desired depth comprising:

a pilot/anchor comprising a bellows having at least a first position in which said pilot/anchor is substantially disengaged from a borehole wall and a second position in which said pilot/anchor is substantially engaged with said borehole wall and, while in said second position, substantially prevents upward and downward movement of said pilot/anchor along a central axis of said borehole;

a power transfer unit adapted for coupling with a drill string and operable to move in either an upward or downward direction along said central axis of said borehole;

a central conduit extending between said pilot/anchor and said power transfer unit; and one or more flexible cutting elements coupled between said pilot/anchor and said power transfer unit, and arranged such that when said pilot/anchor is in said second position and said drill string bears downwardly on said power transfer unit, said power transfer unit moves downward within said borehole thereby deploying and locking said one or more cutting elements into position to remove material from said borehole wall, and when said drill string moves upwardly said power transfer unit moves upward within said borehole, thereby unlocking and retracting said one or more cutting elements.

2. The apparatus as in claim 1 further comprising a stop attached to said central conduit and located so as to limit inward movement of said one or more flexible cutting elements when fully retracted.

3. The apparatus as in claim 1 wherein said pilot/anchor transitions from said first position to said second position by introduction of drilling mud or other fluid into said bellows.

4. The apparatus as in claim 1 wherein each of said one or more flexible cutting elements comprises ends which are rotatable when engaged within first and second couplings, respectively.

5. The apparatus as in claim 4 wherein said first coupling comprises a footplate assembly disposed adjacent to said pilot/anchor.

6. The apparatus as in claim 4 wherein said second coupling comprises a headplate assembly disposed adjacent to said power transfer unit.

7. The apparatus as in claim 1 wherein said drill string is operable to rotate said apparatus within said borehole.

8. The apparatus as in claim 1 wherein said flexible cutting elements are adapted to reduce shock and vibration on said drill string when deployed in position to remove material from said borehole wall.

9. The apparatus as in claim 1 further comprising a spinal rod disposed within said central conduit and providing axial stability and rigidity of said apparatus during operation.

10. A method of expanding a diameter of a borehole comprising:

(A) placing at a desired depth in said borehole a borehole reamer comprising a power transfer unit adapted for coupling with a drill string, a pilot/anchor comprising a bellows which transitions from a first position in which said pilot/anchor is substantially disengaged from a borehole wall to a second position in which said pilot/anchor is substantially engaged with said borehole wall and one or more flexible cutting elements coupled between said power transfer unit and said pilot/anchor;

(B) engaging said pilot/anchor with said borehole wall such that said pilot/anchor substantially prevents upward and downward movement of said pilot/anchor along a central axis of said borehole;

(C) using said drill string to bear downwardly on said power transfer unit, thereby causing said one or more cutting elements to deploy into position to remove material from said borehole wall thereby expanding the diameter of said borehole;

(D) using said power transfer unit to lock said one or more deployed cutting elements in said position to remove material from said borehole wall;

(E) disengaging said pilot/anchor from said borehole wall;

(F) using said drill string to pull upward said borehole reamer; and (G) using said power transfer unit to unlock and retract said one or more cutting elements.

11. The method as in claim 10 wherein in step (B) said pilot/anchor is engaged by introduction of drilling mud or other fluid pressure into said pilot/anchor.

12. The method as in claim 10 wherein steps (C), (D), (E) and (F) are used to backream the borehole.

13. The method as in claim 10 wherein steps (A), (B), (C), (D), (E), (F) and (G) are repeatable at multiple desired depths at some distance removed from said first desired depth.

14. The method as in claim 10 wherein steps (A), (B), (C), (D), (E), (F) and (G) are repeatable so as to uniformly and substantially extend an initial expansion of the borehole diameter through multiple cycles of interconnected reamings and backreamings.

15. The method as in claim 10 wherein step (B) is performed by increasing fluid pressure in said pilot/anchor.

16. The method as in claim 10 wherein said one or more deployed flexible cutting elements are rotated to remove material from said borehole wall.

17. The method as in claim 10 wherein step (D) is automatically performed by drill string torsion.

18. The method as in claim 10 wherein step (E) is performed by decreasing fluid pressure in said pilot/anchor.

19. The method as in claim 10 wherein step (G) is performed by momentary reverse rotation of the drill string.

20. The method as in claim 10 wherein following step (G) said borehole reamer is retrieved from said borehole by pulling upward on said drill string.

* * * * *